US009376931B2

(12) United States Patent
Iyer et al.

(10) Patent No.: US 9,376,931 B2
(45) Date of Patent: Jun. 28, 2016

(54) TURBOMACHINE PASSAGE CLEANING SYSTEM

(75) Inventors: Arun Meenakshinatha Iyer, Greenville, SC (US); Douglas Scott Byrd, Greer, SC (US); Gary Michael Itzel, Simpsonville, SC (US); Jaime Javier Maldonado, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1021 days.

(21) Appl. No.: 13/359,962

(22) Filed: Jan. 27, 2012

(65) Prior Publication Data

US 2013/0195694 A1 Aug. 1, 2013

(51) Int. Cl.
*F04D 29/58* (2006.01)
*F01D 25/00* (2006.01)

(52) U.S. Cl.
CPC ..... *F01D 25/002* (2013.01); *F04D 29/5846* (2013.01); *F05D 2210/13* (2013.01); *F05D 2260/2322* (2013.01); *F05D 2260/607* (2013.01)

(58) Field of Classification Search
CPC ... F16H 41/30; F01D 25/002; F01D 2210/13; F01D 2260/2322; F01D 2260/607; F04D 29/5846
USPC ..... 60/336
See application file for complete search history.

(56) References Cited

U.S. PATENT DOCUMENTS 5,918,466 A 7/1999 Cloyd et al.
6,152,978 A * 11/2000 Lundquist ..... 55/385.1
6,216,880 B1 * 4/2001 Previero ..... 210/359
6,672,147 B1 * 1/2004 Mazet ..... 73/114.43
8,240,153 B2 8/2012 Childers et al.

(Continued)

FOREIGN PATENT DOCUMENTS

CN 101581252 A 11/2009
EP 0350272 A1 1/1990
EP 0515878 A2 12/1992

(Continued)

OTHER PUBLICATIONS

English abstract of Russian Patent 2324062, published May 10, 2008.

(Continued)

*Primary Examiner* — Charles Freay
*Assistant Examiner* — Philip Stimpert
(74) *Attorney, Agent, or Firm* — Ernest G. Cusick; Frank A. Landgraff

(57) ABSTRACT

A turbomachine passage cleaning system includes a first airflow passage having a first inlet configured and disposed to fluidly connect to a compressor portion, a first outlet configured and disposed to fluidly connect to a turbine portion, and a first intermediate portion including a first strainer. A second airflow passage is fluidly coupled to the first airflow passage. The second airflow passage has a second intermediate portion having second strainer. A first valve is arranged in the first intermediate portion upstream from the first strainer, and a second valve is arranged in the second intermediate portion upstream from the second strainer. The first and second valves are selectively operated to control fluid flow into respective ones of the first and second airflow passages to filter air passing from a turbomachine compressor portion to a turbomachine turbine portion.

17 Claims, 1 Drawing Sheet

(56) References Cited

U.S. PATENT DOCUMENTS

| | | | | |
|---|---|---|---|---|
| 2003/0024232 | A1 | 2/2003 | Snyder et al. | |
| 2008/0178571 | A1* | 7/2008 | So et al. | 60/39.55 |

FOREIGN PATENT DOCUMENTS

| | | | |
|---|---|---|---|
| EP | 1859896 | A1 | 11/2007 |
| EP | 1882510 | A1 | 1/2008 |
| EP | 1908939 | A2 | 4/2008 |
| JP | 1147640 | A | 2/1999 |
| JP | 1182065 | A | 3/1999 |
| RU | 2392463 | C1 | 6/2010 |
| WO | 2004055334 | A1 | 7/2004 |
| WO | 2005077554 | A1 | 8/2005 |

OTHER PUBLICATIONS

Unofficial English translation of Chinese Office Action issued in connection with corresponding CN Application No. 201310028835.3 on Aug. 5, 2015.

* cited by examiner

TURBOMACHINE PASSAGE CLEANING SYSTEM

BACKGROUND OF THE INVENTION

The subject matter disclosed herein relates to of turbomachines and, more particularly, to a turbomachine passage cleaning system.

Turbomachines include compressor portion linked to a turbine portion. The turbine portion includes a plurality of blades or buckets that extend along a gas path. The buckets are supported by a number of turbine rotors that define a plurality of turbine stages. A combustor assembly generates hot gases that are passed through a transition piece toward the plurality of turbine stages. In addition to hot gases from the combustor assembly, extraction air at a lower temperature flow from the compressor portion toward the turbine portion for cooling.

It is desirable to reduce contaminates in the extraction air that might clog or otherwise block passages in the combustor assembly and/or turbine portion. Generally, the compressor portion includes intake filters that reduce foreign object ingestion. While effective, foreign object debris having a small particle size may flow through the inlet filter. In addition, foreign object debris may enter the compressor portion during inlet filter replacement. Currently, a high pressure cleaning fluid is passed through the passages to dislodge and/or break up foreign object debris that bypasses the intake filter.

BRIEF DESCRIPTION OF THE INVENTION

According to one aspect of the exemplary embodiment, a turbomachine passage cleaning system includes a first airflow passage having a first inlet configured and disposed to fluidly connect to a compressor portion, a first outlet configured and disposed to fluidly connect to a turbine portion, and a first intermediate portion that extends between the first inlet and the first outlet. A first strainer is arranged in the first intermediate portion. A second airflow passage is fluidly coupled to the first airflow passage. The second airflow passage has a second inlet arranged upstream of the first inlet, a second outlet arranged downstream of the first outlet, and a second intermediate portion that extends between the second inlet and the second outlet. A second strainer is arranged in the second intermediate portion. A first valve is arranged in the first intermediate portion upstream from the first strainer and downstream from the first inlet, and a second valve is arranged in the second intermediate portion upstream from the second strainer and downstream from the second inlet. The first and second valves are selectively operated to control fluid flow into the first and second airflow passages respectively to filter air passing from a turbomachine compressor portion to a turbomachine turbine portion.

According to another aspect of the exemplary embodiment, a method of filtering an airflow passing from a compressor portion toward a turbine portion in a turbomachine includes guiding the airflow into a first airflow passage fluidly connecting the compressor portion and the turbine portion, passing the airflow through a first strainer arranged in the first airflow passage, sensing the airflow through the first strainer, closing a first valve to discontinue airflow through the first airflow passage when airflow through the first strainer is at a first predetermined rate, opening a second valve to divert the airflow into a second airflow passage fluidly connecting the compressor portion and the turbine portion, and passing the airflow through a second strainer arranged in the second airflow passage.

According to yet another aspect of the exemplary embodiment, a turbomachine includes a compressor portion, a turbine portion mechanically linked to the compressor portion, a combustor assembly fluidly connected to the compressor portion and the turbine portion, and a turbomachine passage cleaning system fluidly connected between the compressor portion and the turbine portion. The turbomachine passage cleaning system includes a first airflow passage having a first inlet configured and disposed to fluidly connect to the compressor portion, a first outlet configured and disposed to fluidly connect to the turbine portion, and a first intermediate portion that extends between the first inlet and the first outlet. A first strainer is arranged in the first intermediate portion. A second airflow passage is fluidly coupled to the first airflow passage. The second airflow passage has a second inlet arranged upstream of the first inlet, a second outlet arranged downstream of the first outlet, and a second intermediate portion that extends between the second inlet and the second outlet. A second strainer is arranged in the second intermediate portion. A first valve is arranged in the first intermediate portion upstream from the first strainer and downstream from the first inlet, and a second valve is arranged in the second intermediate portion upstream from the second strainer and downstream from the second inlet. The first and second valves being selectively operated to control fluid flow into respective ones of the first and second airflow passages to filter air passing from a turbomachine compressor portion to a turbomachine turbine portion.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
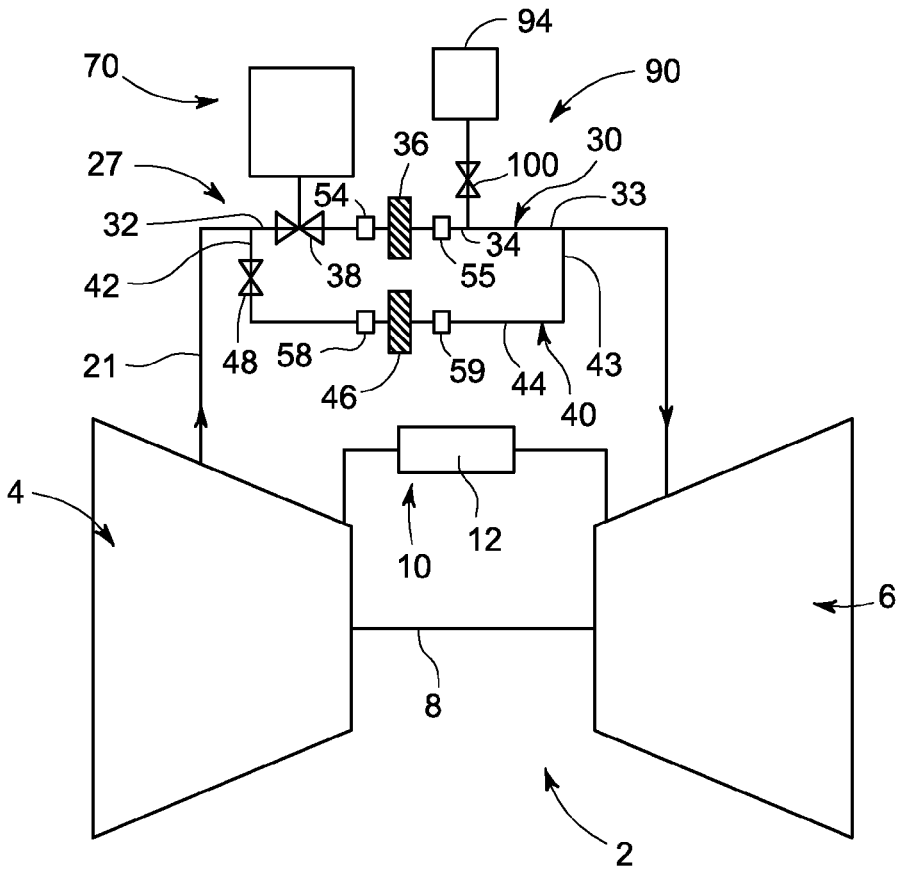
FIG. 1 is a schematic view of a turbomachine including a passage cleaning system in accordance with an exemplary embodiment.
Figure 2:
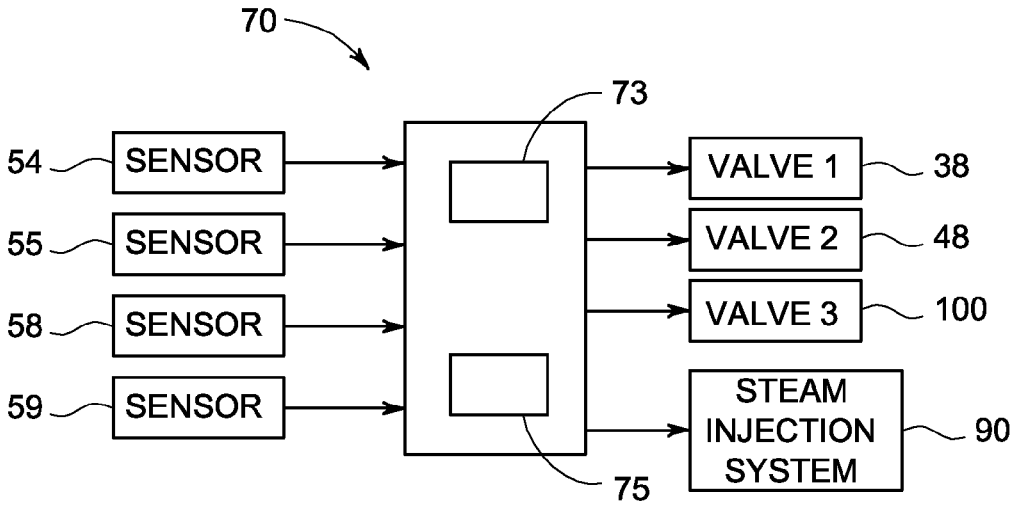
FIG. 2 is block diagram illustrating a controller for the passage cleaning system of FIG. 1.

With reference to FIG. 1, a turbomachine constructed in accordance with an exemplary embodiment is indicated generally at 2. Turbomachine 2 includes a compressor portion 4 mechanically linked to a turbine portion 6 through a common compressor/turbine shaft 8. A combustor assembly 10 is fluidly connected to compressor portion 4 and turbine portion 6. Combustor assembly 10 is formed from a plurality of circumferentially spaced combustors, one of which is indicated at 12. Of course it should be understood that combustor assembly 10 could include other arrangements of combustors. With this arrangement, compressor portion 4 delivers compressed air to combustor assembly 10. The compressed air mixes with a combustible fluid to form a combustible mixture. The combustible mixture is combusted in combustor 12 to form products of combustion that are delivered to turbine portion 6 through a transition piece (not shown). The products of combustion expand through turbine portion 6 to power, for example, a generator, a pump, a vehicle or the like (also not shown).

Turbomachine 2 is also shown to include an extraction airflow passage 21 that fluidly connects compressor portion 4 to turbine portion 6. With this arrangement, in addition to passing compressed air to combustor assembly 10, compressor portion 4 delivers another or extraction airflow to turbine portion 6. The extraction airflow provides cooling for various components (not shown) of turbine portion 6. During operation, foreign objects may enter an inlet (not separately labeled) of compressor portion 4. The foreign objects may be compressed through compressor portion 4 and pass through an extraction airflow passage 21 to turbine portion 6. Foreign objects in turbine portion 6 may clog cooling passages and starve turbine components from cooling air. Turbine components starved from cooling air may fail requiring turbomachine 2 to be taken offline for repair. In order to reduce foreign object damage, turbomachine 2 includes a turbomachine passage cleaning system 27.

In accordance with the exemplary embodiment, passage cleaning system 27 includes a first airflow passage 30 fluidly connected to extraction airflow passage 21. First airflow passage 30 includes a first inlet 32, a first outlet 33, and a first intermediate portion 34. A first strainer 36 is arranged along first intermediate portion 34. First strainer 36 filters extraction air passing from compressor portion 4 to turbine portion 6 through extraction airflow passage 21. A first valve 38 is positioned downstream from first inlet 32. As will be discussed more fully below, first valve 38 is selectively operated to control fluid flow through first airflow passage 30. Passage cleaning system 27 also includes a second airflow passage 40 fluidly connected to first airflow passage 30. Second airflow passage 40 includes a second inlet 42 arranged upstream from first inlet 32, a second outlet 43 arranged downstream from first outlet 33, and a second intermediate portion 44. A second strainer or filter 46 is arranged along second intermediate portion 44. In a manner similar to that described above, a second valve 48 is positioned downstream from second inlet 42. In the event a clogging concern exists, second valve 48 is selectively operated to control fluid flow through second airflow passage 40 thereby ensuring a continuous supply of cooling air into turbine portion 6. In this manner, the exemplary embodiment eliminates the need to shut-down turbomachine 2 for repair.

In further accordance with an exemplary embodiment, passage cleaning system 27 includes first and second sensors 54 and 55 arranged along first intermediate portion 34. First sensor 54 is arranged upstream of first strainer 36 and second sensor 55 is arranged downstream from first strainer 36. First sensor 54 senses flow into first strainer 36 while second sensor 55 senses flow out from first strainer 36. As will be discussed more fully below, first and second sensors 54 and 55 provide a first flow signal that can be monitored to determine a status of first strainer 36. That is, by monitoring flow rate along first airflow passage 30, a determination can be made when first strainer 36 requires cleaning and/or replacement. Passage cleaning system 27 also includes third and fourth sensors 58 and 59 arranged along second intermediate portion 44. Third sensor 58 is arranged upstream of second strainer 46 and fourth sensor 59 is arranged downstream from second strainer 46. Third sensor 58 senses flow into second strainer 46 while fourth sensor 59 senses flow out from second strainer 46. As will be discussed more fully below, third and fourth sensors 58 and 59 provide a second flow signal that can be monitored to determine a status of second strainer 46. That is, by monitoring flow rate along second airflow passage 40, a determination can be made when second strainer 46 requires cleaning and/or replacement.

In still further accordance with an exemplary embodiment, passage cleaning system 27 includes a controller 70 operatively connected to each of the first and second valves 38 and 48, as well as the first, second, third, and fourth sensors 54 and 55, and 58 and 59. Controller 70 includes a central processing unit or CPU 73 and a memory 75. Memory 75 includes a set of instructions that enables controller 70 to monitor sensors 54, 55, 58, and 59 and control first and second valves 38 and 48. More specifically, controller 70 monitors fluid flow through first airflow passage 30 and, more specifically, through first strainer 36. Once controller 70 determines that a flow rate through first strainer 36 falls below a predetermined rate, controller 70 closes first valve 38 cutting off flow through first airflow passage 30, and second valve 48 is opened allowing flow to pass through second airflow passage 40. At this time, first strainer may be serviced/cleaned or replaced. Controller 70 monitors sensors 58 and 59 to determine a flow rate through second airflow passage 40. Once the flow rate through second airflow passage 40 falls below a predetermined rate, controller 70 closes second valve 48 and opens first valve 38 returning the flow through first airflow passage 30.

In still further accordance with the exemplary embodiment, passage cleaning system 27 includes a steam injection system 90. Steam injection system 90 includes a source of steam 94 fluidly connected to first airflow passage 30 through a third valve 100. Valve 100 is coupled to controller 70 and selectively activated to deliver a cleansing flow of steam into turbine portion 6. Of course, it should be understood that the particular connection of steam injection system 90 to passage cleaning system 27 could vary and could include a direct connection to turbine portion 6. Steam injection system 90 is selectively operated to introduce a flow of high pressure steam into turbine portion 6 to loosen, dislodge, disintegrate or otherwise remove particles that may be clinging to internal cooling passage surfaces.

Steam injection system 90 could be operated during various operating modes of turbomachine 2 depending upon local operating conditions, demands, and/or requirements. The high pressure steam would not only provide a cleaning effect but also provide cooling to turbine components. Thus, when desired, controller 70 closes first and second valves 38 and 48 and opens third valve 100 to cause high pressure steam to flow from source of steam 94 toward turbine portion 6. As noted above, the high pressure steam not only provides additional cleaning to cooling circuits in turbine portion 6 but also provides a cooling effect. Steam will continue to flow from source of steam 94 until controller 70 closes third valve 100 and opens one of first and second valves 38 and 48 allowing extraction air to flow from compressor portion 4 to turbine portion 6.

At this point it should be understood that the exemplary embodiments describe a turbomachine passage cleaning system that includes parallel strainers that selectively filter compressor extraction airflowing to turbine portion 6. In addition to filtering extraction air, the passage cleaning system selectively introduces high pressure steam into the turbine portion to provide additional cleaning and cooling. The particular location of the passage cleaning system could vary. In addition, the number and location of the sensors could vary. Further, it should be understood that the sensors could be configured to measure flow, pressure or other parameters that would provide an indication of flow through a corresponding strainer. Accordingly, the passage cleaning system in accordance with the exemplary embodiment utilizes multiple valves to modulate, and ensure a continuous supply of compressor extraction air to internal cavities of the turbine at all times. The use of multiple valves allows the flow of extraction air to continue and reduces the need to shut down the gas turbine system for potential clogging/maintenance concerns in the cooling air passages While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine passage cleaning system comprising:

a first airflow passage having a first inlet configured and disposed to fluidly connect to a compressor portion, a first outlet configured and disposed to fluidly connect to a turbine portion, and a first intermediate portion that extends between the first inlet and the first outlet;

a first strainer arranged in the first intermediate portion;

a second airflow passage fluidly coupled to the first airflow passage, the second airflow passage having a second inlet arranged upstream of the first inlet, a second outlet arranged downstream of the first outlet, and a second intermediate portion that extends between the second inlet and the second outlet;

a second strainer arranged in the second intermediate portion;

a first valve arranged in the first intermediate portion upstream from the first strainer and downstream from the first inlet;

a second valve arranged in the second intermediate portion upstream from the second strainer and downstream from the second inlet, the first and second valves being selectively operated to control fluid flow into respective ones of the first and second airflow passages to filter air passing from a turbomachine compressor portion to a turbomachine turbine portion; and a steam injection system selectively fluidly coupled to one of the first and second airflow passages through a valve arraged downstream of the first and second strainers, the steam injection system delivering a flow of steam through the one of the first and second airflow passages toward a turbine portion of the turbomachine.

2. The turbomachine passage cleaning system according to claim 1, further comprising: a first sensor arranged downstream of the first strainer, the first sensor being configured to sense a flow from the first strainer and provide a first flow signal.

3. The turbomachine passage cleaning system according to claim 2, further comprising: a second sensor arranged downstream of the second strainer, the second sensor being configured to sense a flow from the second strainer and provide a second flow signal.

4. The turbomachine passage cleaning system according to claim 3, further comprising: a controller operatively connected to each of the first valve, the second valve, the first sensor and the second sensor, the controller being programmed to selectively operate the first and second valves based on one or more of the first and second flow signals.

5. The turbomachine passage cleaning system according to claim 4, further comprising: a third sensor arranged upstream of the first strainer, the third sensor being configured and disposed to sense a flow into the first strainer.

6. The turbomachine passage cleaning system according to claim 5, further comprising: a fourth sensor arranged upstream of the second strainer, the fourth sensor being configured and disposed to sense a flow into the second strainer.

7. The turbomachine passage cleaning system according to claim 6, wherein the controller is operatively connected to each of the third and fourth sensors, the controller being programmed to determine a status of each of the first and second strainers based on signals from the first, second. third, and fourth sensors.

8. The turbomachine passage cleaning system according to claim 1, further comprising: a controller operatively connected to the steam injection system, the controller being programmed to selectively close each of the first and second valves and activate the steam injection system.

9. A method of filtering an airflow passing from a compressor portion toward a turbine portion in a turbomachine, the method comprising:

guiding the airflow into a first airflow passage fluidly connecting the compressor portion and the turbine portion;

passing the airflow through a first strainer arranged in the first airflow passage;

sensing the airflow through the first strainer;

closing a first valve to discontinue airflow through the first airflow passage when airflow through the first strainer is at a first predetermined rate;

opening a second valve to divert the airflow into a second airflow passage fluidly connecting the compressor portion and the turbine portion;

passing the airflow through a second strainer arranged in the second airflow passage; and selectively guiding a steam flow through one of the first and second airflow passages toward the turbine portion.

10. The method of claim 9, further comprising: sensing the airflow through the second strainer.

11. The method of claim 10, further comprising: closing the second valve and opening the first valve when the airflow through the second strainer is at a second predetermined rate.

12. A turbomachine comprising:

a compressor portion;

a turbine portion mechanically linked to the compressor portion;

a compressor assembly fluidly connected to the compressor portion and the turbine portion; and a turbomachine passage cleaning system fluidly connected between the compressor portion and the turbine portion, the turbomachine passage cleaning system comprising:

a first airflow passage having a first inlet configured and disposed to fluidly connect to a compressor portion, a first outlet configured and disposed to fluidly connect to a turbine portion, and a first intermediate portion that extends between the first inlet and the first outlet;

a first strainer arranged in the first intermediate portion;

a second airflow passage fluidly coupled to the first airflow passage, the second airflow passage having a second inlet arranged upstream of the first inlet, a second outlet arranged downstream of the first outlet, and a second intermediate portion that extends between the second inlet and the second outlet;

a second strainer arranged in the second intermediate portion;

a first valve arranged in the first intermediate portion upstream from the first strainer and downstream from the first inlet;

a second valve arranged in the second intermediate portion upstream from the second strainer and downstream from the second inlet, the first and second valves being selectable operated to control fluid flow into respective ones of the first and second airflow passages to filter air passing from a turbomachine compressor portion to a turbomachine turbine portion; and a steam injection system selectively fluidly coupled to one of the first and second airflow passages through a valve arranged downstream of the first and second strainers, the steam injection system delivering a flow of steam through the one of the first and second airflow passages toward a turbine portion of the turbomachine.

13. The turbomachine according to claim 12, further comprising:

a first sensor arranged downstream of the first strainer, the first sensor being configured to sense a flow from the first strainer and provide a first flow signal; and a second sensor arranged downstream of the second strainer, the second sensor being configured to sense a flow from the second strainer and provide a second flow signal.

14. The turbomachine according to claim 13, further comprising: a controller operatively connected to each of the first valve, the second valve, the first sensor and the second sensor, the controller being programmed to selectively operate the first and second valves based on one or more of the first and second flow signals.

15. The turbomachine passage cleaning system according to claim 14, further comprising: a third sensor arranged upstream of the first strainer, the third sensor being configured and disposed to sense a flow into the first strainer.

16. The turbomachine according to claim 15, further comprising: a fourth sensor arranged upstream of the second strainer, the fourth sensor being configured and disposed to sense a flow into the second strainer, wherein the controller is operatively connected to each of the first, second, third and fourth sensors, the controller being programmed to determine a status of each of the first and second strainers based in the first and third, and the second and fourth flow signals respectively.

17. The turbomachine according to claim 12, further comprising: a controller operatively connected to the steam injection system and programmed to selectively close each of the first and second valves and activate the steam injection system.

* * * * *